United States Patent [19]

Walker et al.

[11] 4,061,282

[45] Dec. 6, 1977

[54] EASY ACCESS-LOW NOISE GRANULATOR

[75] Inventors: William J. Walker, East Greenwich; Henri A. Boulay, West Warwick, both of R.I.

[73] Assignee: Leesona Corporation, Warwick, R.I.

[21] Appl. No.: 744,179

[22] Filed: Nov. 22, 1976

[51] Int. Cl.[2] ..... B02C 18/22

[52] U.S. Cl. ..... 241/222; 83/859; 241/285 R; 241/285 B

[58] Field of Search ..... 241/222, 224, 225, 277, 241/285 R, 285 A, 285 B; 83/859, 860

[56] References Cited

U.S. PATENT DOCUMENTS

| | | | |
|---|---|---|---|
| 3,643,880 | 2/1972 | Peterson, Jr. | 241/285 B X |
| 3,756,519 | 9/1973 | Reynolds et al. | 241/285 B X |
| 3,837,586 | 9/1974 | Perschbacher et al. | 241/222 X |
| 3,895,761 | 7/1975 | Mills | 241/285 R X |

FOREIGN PATENT DOCUMENTS

| | | | |
|---|---|---|---|
| 341,659 | 7/1972 | U.S.S.R. | 241/222 |

*Primary Examiner*—Joseph H. McGlynn
*Assistant Examiner*—Howard N. Goldberg
*Attorney, Agent, or Firm*—Salter & Michaelson

[57] ABSTRACT

A granulator construction including a cover having a first portion connected to the granulator frame along a vertical hinge line and a second portion in turn connected to the first portion along a horizontal hinge line whereby progressive opening of such cover portions along their respective hinges permits partially and fully open granulator positions whereby the feed means and the granulation chamber of the granulator are sequentially exposed. Furthermore, opposed muffler segments in part defining a feed slot are separable so that access to feed rolls etc. may be quickly gained. The lower of such muffler segments is further slidably removable entirely from the granulator construction so as to permit cleaning as when changeovers occur in the material being granulated.

8 Claims, 6 Drawing Figures

EASY ACCESS-LOW NOISE GRANULATOR

BACKGROUND OF THE INVENTION

Several problems persist in prior art granulator constructions. One such problem deals with the ability to gain access to interior portions of the granulator, including feed slots thereof in those granulator constructions utilizing such feed slots and to the chamber portions thereof especially where the granulating rotor is normally positioned for rotation about a horizontally disposed axis. Difficulty in achieving access to such locations increases the complexity and down time of such granulators and accordingly the profitability thereof. It would be accordingly desirable to achieve a granulator construction which affords easy access to the chamber and feed slot portions thereof in an uncomplicated and accordingly fast manner so that repairs, cleaning, and related procedures may be performed on the unit quickly and without danger to those performing such tasks.

Another problem occurring in prior art granulator constructions, especially those designed for the granulation of sheet material which accordingly provide a feed slot of relatively narrow elongated configuration so as to provide access of such sheet material to the granulation chamber, is air-borne noise. The narrow feed slots of such granulators tend to create or support such air-borne noise. It would accordingly be desirable to suppress such noise in a straightforward, uncomplicated manner so that repair and cleaning access above-stressed could be maintained.

Accordingly, a primary object of the present invention is the provision of a granulator construction in which the feed slot and rotor chamber portions thereof are quickly and easily accessible.

A further object of the present invention is the provision of a granulator construction in which air-borne noise normally present in the feed slot area thereof is suppressed.

A still further object of the invention is the provision of a granulator construction whereby both noise emanating from the feed slot area thereof and access thereto as well as to the rotor chamber is provided by a combined structure in which muffler segments cooperate to form portions of such feed slot and wherein one of such muffler segments is connected to a hinged cover whereby pivotal movement of such cover initially exposes the feed means and sequential pivotal movement thereof exposes the rotor means.

This and other objects of the invention as will become more apparent as the description hereof proceeds are accomplished by the provision of a granulator comprising a rotor chamber and feed means including a feed slot for introducing materials to be granulated into said chamber, a cover having a first portion at least partially enclosing the chamber and a second portion extending above said feed slot wherein said second cover portion includes a first muffler segment attached thereto and downwardly extending therefrom to a position defining the upper extent of the feed slot and a second muffler segment positioned below and in spaced opposition to the first muffler segment so as to define the lower extent of the feed slot wherein progressive pivotal movements of the cover define initially a partially granulator position and thereafter a fully open granulator position wherein respectively the feed means and the rotor chamber are progressively accessible.

Other objects, features and advantages of the invention shall become apparent as the description thereof proceeds when considered in connection with the accompanying illustrative drawing.

DESCRIPTION OF THE DRAWING

In the drawing which illustrate the best mode presently contemplated for carrying out the present invention.

DESCRIPTION OF THE INVENTION

Figure 1:
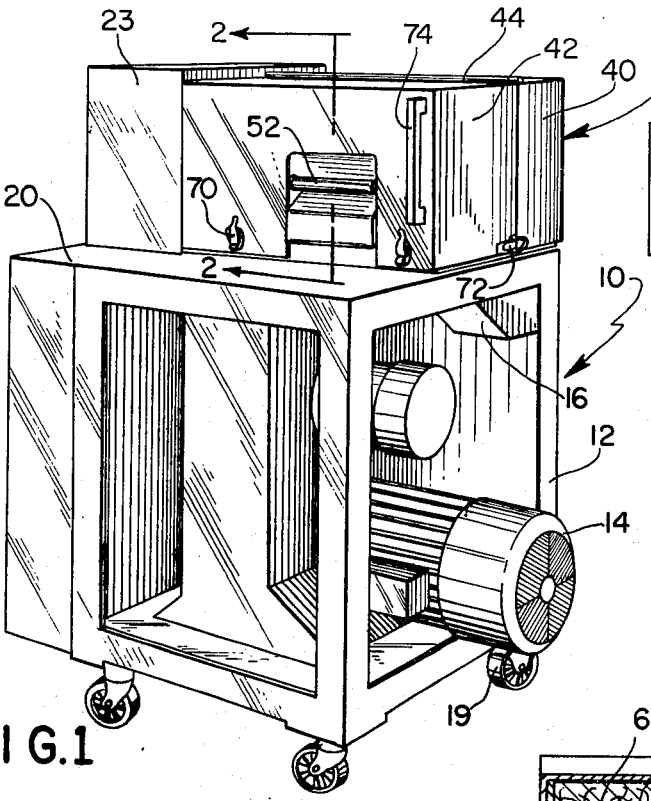
FIG. 1 is an overall perspective view showing a granulator incorporating the novel features of the present invention.

Turning now to the drawing, in particular FIG. 1 thereof, the granulator 10 of the present invention is depicted. The term granulator as utilized herein is intended to generically include other relevant size reduction equipment regardless of the physical makeup of the feed material and specifically includes strand pelletizers. The frame portion 12 serves to support the granulator including operating aspects thereof such as the motor 14 depicted. The frame 12 may be of any desired configuration and may support a delivery chute 16 for moving material granulated for further processing. The granulator 10 may be portable, i.e., including casters 19, or fixed in position as is known in the art. The frame 12 may further include segments such as drive guard or housing 23 and the tablelike surface 20, a continuation of which serves to at least in part define a portion of the internal configuration of the granulator including a chamber 22 thereof.

Such chamber includes a pair of space trunnions 24 suitably fixed to the frame as by ear portions 26 via bolts 28 from which a horizontally disposed shaft 30 is supported for rotation as by the motor 14 shown. The shaft in turn includes a rotor 32 having knife blades 34 formed in the outer surface thereof for cooperating cutting action with a bed knife 36 suitably mounted by conventional means so as to project inwardly into the chamber 22.

Figure 3:
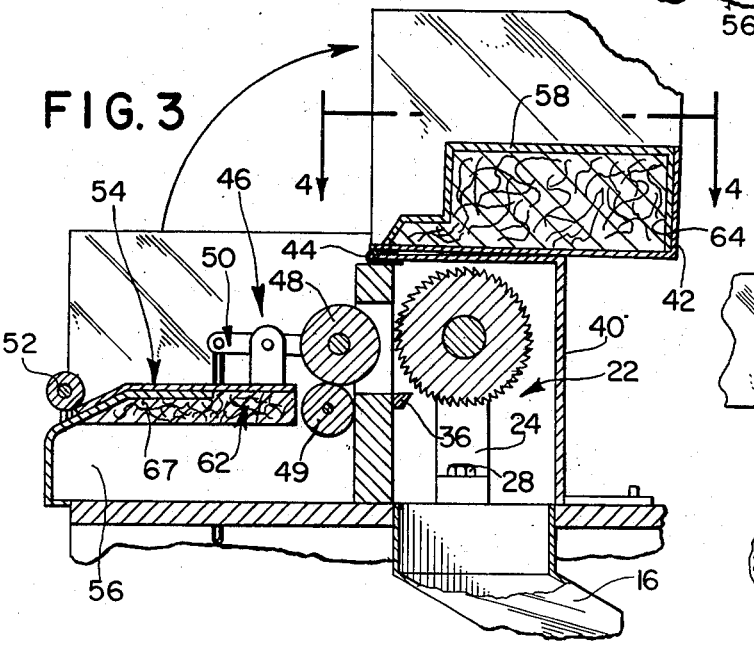
FIG. 3 is a side sectional view similar to FIG. 2 but showing the cover in partially open attitude thereby exposing the feed means of the granulator and thus placing the granulator in a partially open granulator position.

As depicted, a major portion of the chamber 22 is enclosed by means of a cover 38 having a first portion 40 and a second portion 42 longitudinally extending therefrom about a horizontally disposed hinge line 44 wherein such second cover segment 42 is upwardly pivotable about said hinge 44 to the partially open position depicted in FIG. 3 of the drawing wherein the feed means 46 of the granulator is fully accessible for repair, cleaning, etc. Such feed means 46 comprises a pair of feed rollers 48, 49 either or both of which may be driven by means (not shown) and at least one of which is vertically adjustable as by any suitable means such as the conventional hydraulically activated linkage 50 shown. The sheet material can be accordingly adapted to be fed over a guide 52 inwardly into the feed means 46 and driven by means of rollers 48, 49 into the chamber 22 wherein the cooperating cutting action between the rotor 32 and the bed knife 36 accomplishes the desired granulation. Such feed means 46 further includes a feed slot 54 defined in part by a pair of longitudinally orientated horizontally spaced plates 56 from which the hydraulic means 50 may be supported and including inwardly extending slots 57 for receipt of a muffler segment as will hereinafter be described.

Figure 2:
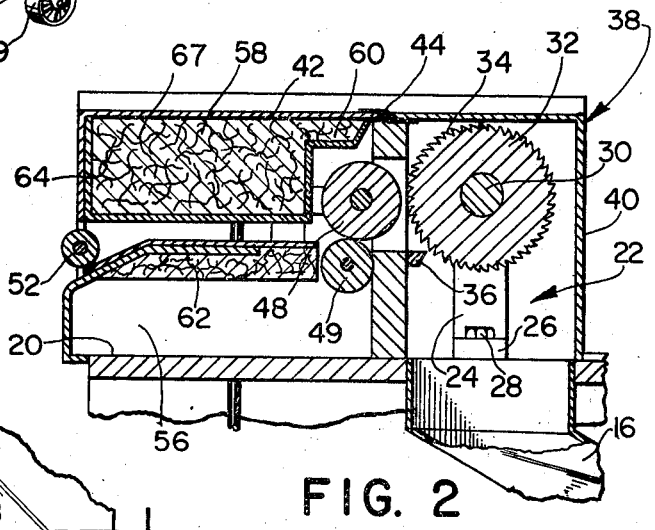
FIG. 2 is a partial sectional taken along the line 2—2 of FIG. 1 and showing in particular the cover portions thereof in fully closed position thus defining the configuration of the feed slot.

The cover first portion 42 further includes a first muffler segment 58 attached to the underneath portions thereof and when assembled in closed position defines the upper extent of the feed slot 54. Such first muffler segment 58 includes a cut away portion 60 of lesser thickness so as to accommodate the drive roll 48 as best shown in FIG. 2 of the drawing. A second muffler segment 62 in turn having side plates 64 including outwardly extending bosses 66 is adapted for sliding engagement with the slots 57 of the plates 56. Such second muffler segment 62 serves to define the lower extent of such feed slot 54. It should be brought out that the muffler segments 58, 62 are accordingly in spaced opposed position from each other so as to accommodate the feeding of material through the feed slot 54 into the chamber 22 and may be of such size so as to define varying height and width feed slots.

Both muffler segments include an outer shell of protective material such as sheet metal and the like having a plurality of spaced openings therethrough and an interior provided with sound absorbing material 67, suitable compositions being known and readily available. Although the physical makeup of such muffler segments forms no part of the present invention, the manner in which they cooperate so as to form the feed slot 54 as well as the manner in which they are both removable for cleaning and access to the feed means 46 are particularly desirable and specifically contribute to the objects of the present invention. Thus, when it is necessary to change over between different materials being granulated, as for instance when different colors are being granulated; the granulator is turned off and thereafter the cover 38 thereof moved to its partially open granulator position, that is, the cover segment 42 is pivoted about its hinge line 44 so that the upper portions of such cover are disposed in face-to-face supporting contact with the upper portions of the first cover portion 40. Such positioning facilitates full access to the feed means 46 for cleaning or adjustment of the feed rolls 48, 49 cleaning normally being carried out by a compressed air source to blow pellets or chips of the previous material being granulated from the surfaces so such will not contaminate the next run. It should also be brought out that the preferred construction shown wherein the upper portions of both cover portions 40, 42 are disposed in the same continuing plane, that support for the second cover portion is provided by the upper portions of the first cover when such second cover has been rotated through a 180° arc. Further, if necessary cushioning material (not shown) may be incorporated onto either surface to cushion the contact therebetween and to reduce scratching, etc. The cover portion 42 is accordingly firmly supported in a stable horizontally disposed position when thereafter further pivoted about the vertical axis as will hereinafter be brought out.

At this time the muffler segment 62 may also be entirely removed from its position beneath the feed slot 54 for cleaning or replacement by sliding such forward or to the left as shown in FIGS. 2 and 3 representation after removing the guide roll 52. It may thus be seen that partial access is almost instantaneously achieved by the novel configuration of the present invention in a safe and easy manner.

Figure 4:
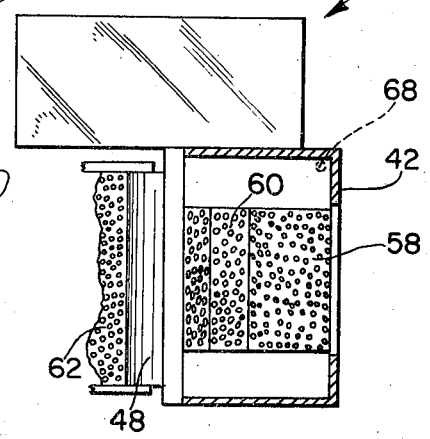
FIG. 4 is a partial top plan view of the granulator in partially open position taken along the line 4—4 of FIG. 3 but on a smaller scale than FIG. 3.
Figure 6:
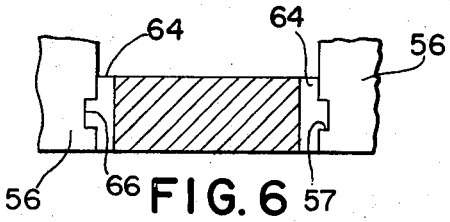
FIG. 6 is a partial front view of the feed portion of the present granulator as viewed from the left of FIG. 2 thereof.
Figure 5:
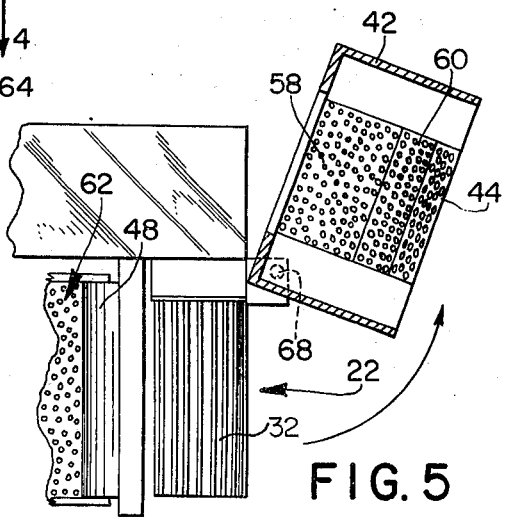
FIG. 5 is a view similar to FIG. 4 but showing the cover in fully hinged position to define a fully open granulator position.

Furthermore, the cover 38 or rather the first cover portion 40 thereof is pivotable about a vertically orientated pivot line 68 as shown in FIGS. 4 and 5 of the drawing so that the cover, once positioned in its partially open granulator attitude may be then sequentially pivoted about the vertical axis 68 so as to clear the cover from the remaining portions of the granulator including drive housing 23 and to accordingly fully remove the cover 38 from both the feed means 46 and the chamber 22; thus not only fully exposing the components making up the feed means but further those components such as the rotor 32 and bed knife 36 housed within the chamber 22. It should be also noted that temporary locking means such as the spring clips 70 depicted in FIG. 1 of the drawing may be utilized to fasten the cover 38, that is, the second portion 42 thereof to the upper surface 20 of the frame. Additionally, the respective first and second portions of the cover 38 may be connected to each other by means of similar spring clips 72. Also a suitable means for elevating the second cover portion 42 such as handle 74 may be provided.

The close proximity of the muffler segments 58, 62 serve to reduce air-borne noise in the feed slot area 54 and their cooperation in the manner above described permits sequential partial and full access to the various areas of the granulator which require attention. Thus, for cleaning access, the cover is adapted to open to an initial position as shown and for more major adjustment or repairs such as would be necessary to those components housed within the chamber 22 the cover is adapted in a sequential movement to move to a fully open granulator position. Accordingly, it is believed that the above described sequential opening cover construction and the segmental muffler feed slot formation contribute to the accomplishment of the objectives of the present invention in a novel and unobvious manner.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A granulator comprising a frame, a chamber, a rotor mounted for rotation about an axis within said chamber, feed means including a feed slot for introducing material into said chamber, said rotor including cutting means for contact with material fed to said chamber for size reduction thereof, a composite cover having first and second cover portions relatively movable with respect to each other and to said frame, said first cover portion at least partially enclosing said chamber, said second cover portion extending above said feed slot, said first cover portion connected to the frame along a vertical hinge line and said second cover portion in turn connected to the first cover portion along a horizontal hinge line whereby progressive opening of said second cover portion with respect to said first cover portion and then said first cover portion with respect to the frame along their respective hinges permits partially and fully open granulator positions whereby said feed means and said chamber are sequentially exposed.

2. The granulator structure of claim 1, wherein said first and second cover portions together in said partially open granulator position are pivotable about said vertical axis to a fully open granulator position to expose said rotor.

3. The granulator construction of claim 1, said second cover portion including a first muffler segment attached thereto and downwardly extending therefrom to a position defining the upper extent of said feed slot, and a second muffler segment supported from said frame and positioned below said first muffler segment in spaced opposition thereto and defining the lower extent of said feed slot.

4. The granulator construction of claim 3, said second muffler slidable in relationship to said frame for removal therefrom.

5. The granulator construction of claim 4, said frame including a pair of spaced plates located on either side of said feed slot and defining the lateral extent thereof, each said plate having an inwardly directed slot for slidable receipt of an outwardly extending member positioned on either side of said second muffler element.

6. The granulator structure of claim 3, upper portions of said cover portions being substantially coplanar, said second cover portion pivotable from a closed granulator position extending above said feed slot to a partially open granulator position wherein said second cover portion is positioned above and supported by said first cover portion.

7. The granulator structure of claim 3, said feed means including at least one feed roll positioned proximal to said chamber within said feed slot, said horizontal hinge line disposed above said feed roll.

8. The granulator structure of claim 7, said first muffler segment generally extending the entire longitudinal extent of said second cover portion and including a reduced thickness first muffler segment portion for receipt of said feed roll.

* * * * *